US005433985A

United States Patent [19]

Atkins

[11] Patent Number: 5,433,985

[45] Date of Patent: Jul. 18, 1995

[54] POOL CLEANER DISC

[75] Inventor: David S. Atkins, Broederstroom, South Africa

[73] Assignee: Zarina Holdings C.V., Netherlands

[21] Appl. No.: 213,666

[22] Filed: Mar. 15, 1994

[30] Foreign Application Priority Data

Mar. 18, 1993 [ZA] South Africa ..... 93/1924

[51] Int. Cl.[6] ..... E04H 4/16

[52] U.S. Cl. ..... 428/66.6; 15/1.7; 15/404; 15/420; 15/246; 428/131; 428/192; 428/167; 428/213; 428/220

[58] Field of Search ..... 428/64, 65, 160, 167, 428/213, 220, 131, 192; 66; 15/1.7, 404, 420, 246; 4/490

[56] References Cited

U.S. PATENT DOCUMENTS

| | | | |
|---|---|---|---|
| 2,215,377 | 9/1940 | Penfield et al. | 255/1 |
| 2,243,935 | 6/1941 | Williamson | 15/2 |
| 2,263,774 | 11/1941 | Heltzel et al. | 15/109.06 |
| 2,275,190 | 3/1942 | Lowry | 15/104.06 |
| 2,392,146 | 1/1946 | Hall | 15/210 |
| 2,809,387 | 10/1957 | Paiso | 15/210 |
| 3,243,830 | 4/1966 | Conrad | 15/1.7 |
| 3,605,171 | 9/1971 | Candor et al. | 15/399 |
| 3,902,215 | 9/1975 | Waldrop et al. | 15/210 B |
| 4,023,227 | 5/1977 | Chauvier | 15/1.7 |
| 4,095,378 | 6/1978 | Urakami | 51/425 |
| 4,133,068 | 1/1979 | Hofmann | 15/1.7 |
| 4,152,802 | 5/1979 | Chauvier | 15/1.7 |
| 4,156,948 | 6/1979 | Chauvier | 15/1.7 |
| 4,193,156 | 3/1980 | Chauvier | 15/1.7 |
| 4,193,469 | 3/1980 | Graf | 180/164 |
| 4,351,077 | 9/1982 | Hofmann | 15/1.7 |
| 4,530,125 | 7/1985 | Hofmann | 15/1.7 |
| 4,642,833 | 2/1987 | Stoltz et al. | 15/1.7 |
| 4,742,593 | 5/1988 | Kallenbach | 15/1.7 |
| 4,849,024 | 7/1989 | Supra | 134/21 |
| 4,852,211 | 8/1989 | Strausak | 15/1.7 |
| 4,949,419 | 8/1990 | Kallenbach | 15/246 |
| 4,979,986 | 12/1990 | Hill et al. | 75/711 |
| 5,014,382 | 5/1991 | Kallenbach | 15/1.7 |

FOREIGN PATENT DOCUMENTS 2355353 5/1975 Germany .

OTHER PUBLICATIONS

Two photographs of a beige disc and bearing the hand-written notation "Jandy".

Two photographs of a blue disc and bearing the hand-written notation "Kreepy Krauley".

One photograph of a black disc and bearing the hand-written notation "Barachuda".

Two photographs of a blue disc for a swimming pool cleaner.

U.S. patent application Ser. No. 08/103,930, filed Aug. 6, 1993, entitled "Swimming Pool Cleaner Discs and Associated Equipment".

U.S. patent application Ser. No. 08/185,451, filed Jan. 24, 1994, entitled "Swimming Pool Cleaner Discs".

*Primary Examiner*—Nasser Ahmad

*Attorney, Agent, or Firm*—Kilpatrick & Cody

[57] ABSTRACT

A disc for use with an automatic swimming pool cleaner which operates on a substantial intermittent reduction in water flow through the swimming pool cleaner is disclosed. The disc is made of flexible material and has grooves formed symmetrically across and into the under surface of the disc.

7 Claims, 2 Drawing Sheets

POOL CLEANER DISC

FIELD OF THE INVENTION

This invention relates to discs which are used on certain kinds of swimming pool cleaners primarily to hold the pool cleaner against the surface which is to be cleaned.

BACKGROUND OF THE INVENTION

These discs are made of flexible material so that they can, under operating conditions, follow the contours of the floor and walls of a swimming pool. Particularly the flexibility enables the swimming pool cleaner to traverse the corner formed between vertical and horizontal surfaces. Usually a compromise must be reached in obtaining the desired flexibility while still maintaining the disc properly functional under the suction induced by water flow through the cleaner.

SUMMARY AND OBJECT OF THE INVENTION

According to this invention there is provided a disc of the kind referred to in which grooves are formed symmetrically into and across the under surface of the disc. Further features of this invention provide for the grooves to be at least predominantly radially located or for a pair of grooves spaced apart on each side of a diametrical center line to be provided or for a combination of both patterns of grooves to be provided.

The invention also provides for the grooves to be about 5 mm wide and to extend to a depth about three quarters through the thickness of the disc material in some embodiments. Other objects, features, and advantages of the present invention will become apparent with reference to the remainder of the written portion and the drawings of this application.

BRIEF DESCRIPTION OF THE DRAWINGS

Preferred examples of this invention are described below with reference to the accompany drawings in which.

DETAILED DESCRIPTION OF THE INVENTION

The flexible disc (1) with which this invention is concerned may be used with different kinds of suction operated pool cleaner which consist essentially of a head having a passage therethrough. The inlet end of the passage opens in use adjacent to the surface being cleaned and the disc fits around the head adjacent the inlet. It is rotatable relative to the head.

The outlet from the head is connected to the suction hose for the filter plant for the swimming pool. The head includes a mechanism which intermittently causes a substantial reduction or interruption of the flow through the head. This in turn results in forces being generated in the pool cleaner which causes the cleaner to move in stepwise manner over the surface to be cleaned.

The disc (1) stabilizes the cleaner on the surface being cleaned and its movement over the surface assists in dislodging dirt and debris from the surface to facilitate entrainment of this material into the filter plant. The disc is particularly suitable with swimming pool cleaners disclosed in U.S. Pat. Nos. 4,133,068, 4,642,833, and 4,023,227, each incorporated herein in its entirety by this reference.

Figure 6:
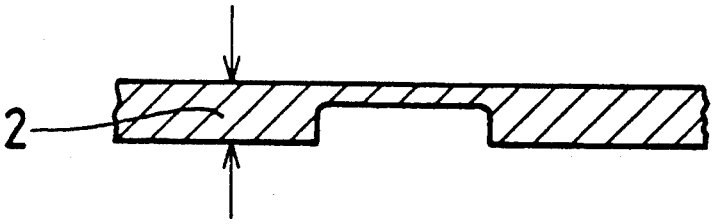
FIG. 6 is a detail.

The disc (1) of this invention has grooves provided in the underside, that is the side in contact with the surface to be cleaned. These grooves, as indicated in FIG. 6, where the thickness of material (2) is about 3 mm, will be about 2.5 mm deep and about 5 or 6 mm wide.

Figure 1:
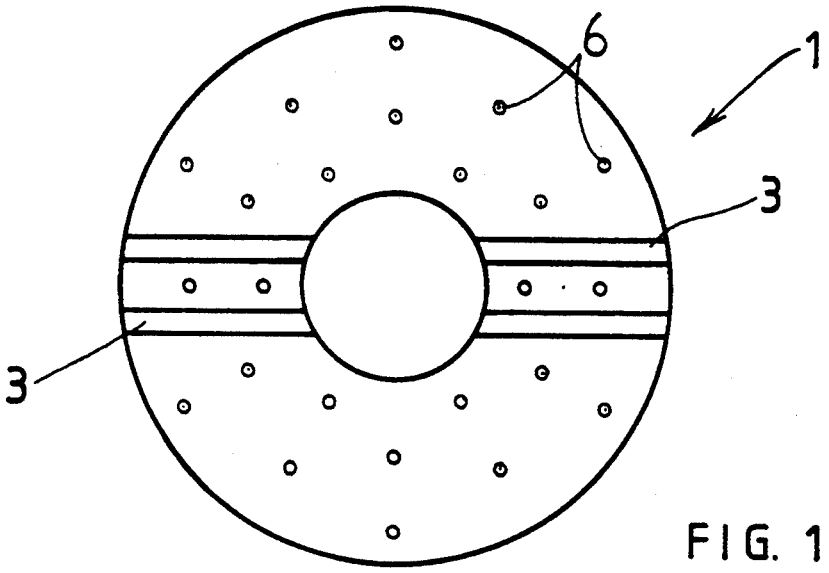
FIGS. 1 to 3 illustrate different patterns of grooves.
Figure 2:
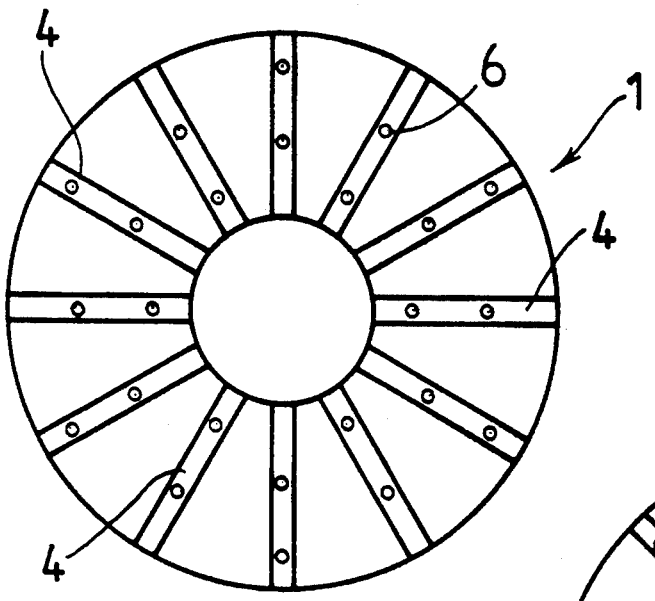
Figure 3:
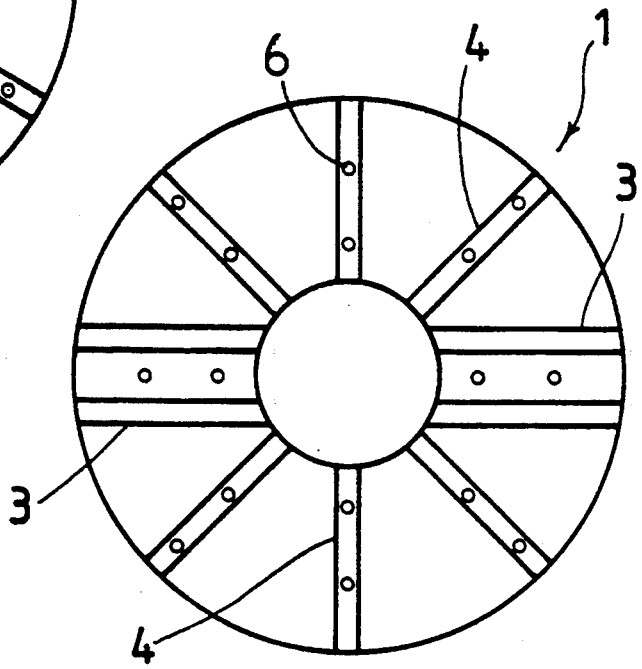
Figure 4:
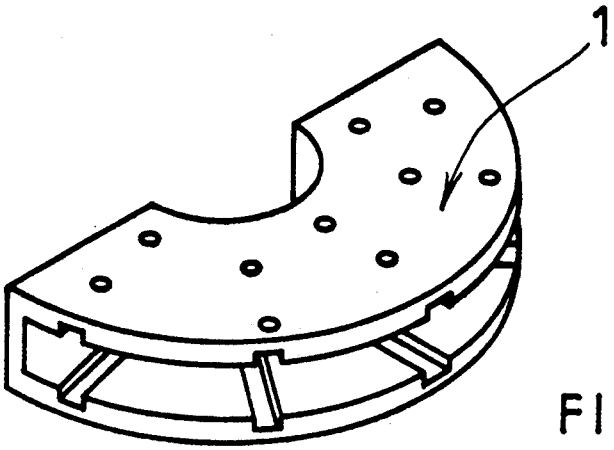
FIGS. 4 and 5 illustrate two ways of folding the discs.
Figure 5:
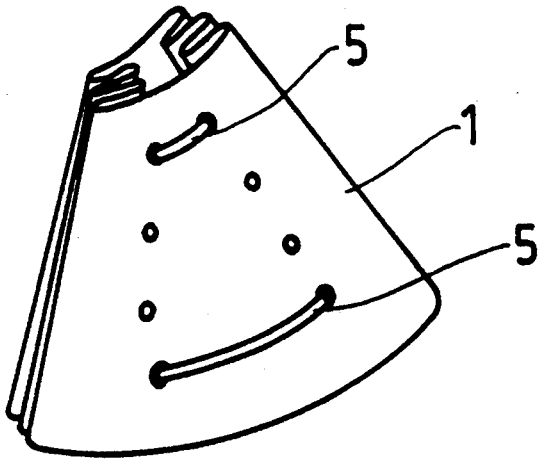

In FIG. 1 there are a pair of grooves (3), one on each opposite side and parallel to a diametrical center line. This enables the disc to be folded into the shape shown in FIG. 4. In FIG. 2 the grooves (4) extend radially from the center hole and this configuration of grooves enables the disc to be folded into the fan shape indicated in FIG. 5. The disc can be retained in this fan shape for storage and transport with simple clips indicated at (5). FIG. 3 shows a combination of the grooves (3) and (4) in FIGS. 1 and 2. The usual array of symmetrical arrangement of small holes (6) is provided to reduce the force with which the disc adheres to the surface being cleaned when the cleaner is in use.

It will be appreciated that the greater the number of grooves the more flexible the disc becomes in use. This has a marked effect on the kind of material which may be used and on the method of manufacture of the discs. For example, a polyurethane disc of shore 82A hardness with grooves will give a better performance than the usually required softer material of shore 78A. This latter material often gives rise to difficulty in arriving at a desired flexibility and instability of the pool cleaner during use.

The discs can also be molded in the folded shapes illustrated. The advantages of this are significant. The current projected area requires a large and robust die set, inevitably a single cavity set, with individual pins for individual holes (6) and the associated flashing problems. By molding in one of the folded conditions, the projected areas can be reduced by half or quarter, or even less if the molding is effected edge on. Also holes (6) could be made using retractable through pins, in one possibility each pin producing up to 6 holes, and multi-cavity dies or singles on smaller machines becomes a possibility with the associated cost savings.

The discs (1) can be folded for packaging and storage with consequent savings in space and packaging materials. Experience has shown that when the discs (1) are folded into the shapes indicated in FIGS. 4 and 5 they will soon return to the flat operative position when used. This return will of course be more quickly achieved if the discs are laid flat in the sunshine before being put into a pool. The provision of the grooves (3) thus enables a better performance to be obtained at lower overall cost.

The foregoing is provided for purposes of illustration, explanation, and description of embodiments of the present invention. Modifications and adaptations to these embodiments will be apparent to those skilled in the art and may be made without departing from the scope and spirit of the invention.

I claim:

1. A swimming pool cleaning flexible disc having an outer perimeter, a diameter, a central aperture with a center, and adapted to receive a portion of a swimming pool cleaner, comprising:

a. an upper surface;

b. a lower surface defining an axis spanning the diameter and passing through the center of the central aperture;

c. a first groove formed in the lower surface parallel to the axis and extending nonradially from the central aperture to the outer perimeter; and d. a second groove formed in the lower surface parallel to the axis and opposite the axis from the first groove, which second groove extends nonradially from the central aperture to the outer perimeter.

2. A flexible disc according to claim 1 further comprising a plurality of third grooves formed in the lower surface and extending radially from the central aperture to the outer perimeter.

3. A flexible disc according to claim 1 further comprising a plurality of openings smaller than the central aperture that extend through the disc from the upper surface to the lower surface.

4. A flexible disc having an outer perimeter, a central aperture with a center and a boundary defining an inner perimeter, and adapted to receive a portion of a swimming pool cleaner, comprising:

a. an upper surface terminating at the outer perimeter;

b. a lower surface terminating at the outer perimeter; and c. a plurality of grooves in the lower surface that extend from the inner perimeter to the outer perimeter and are symmetrical about the center of the aperture to facilitate folding of the disc.

5. A flexible disc according to claim 4 in which the grooves penetrate into the lower surface to a depth of about three quarters the thickness of the disc.

6. A flexible disc having a diameter, an outer perimeter, a central aperture with a center and a boundary defining an inner perimeter, and adapted to receive a portion of a swimming pool cleaner, comprising:

a. an upper surface terminating at the outer perimeter;

b. a lower surface terminating at the outer perimeter; and c. two first grooves corresponding to two parallel chords that are symmetrical about the diameter to facilitate folding of the disc.

7. A flexible disc according to claim 6 further comprising a plurality of second grooves in the lower surface that extend from the inner perimeter to the outer perimeter and are symmetrical about the center of the aperture.

* * * * *